United States Patent [19]

Schäberle

[11] 4,345,446

[45] Aug. 24, 1982

[54] CIRCULAR KNITTING MACHINE FOR PRODUCING HIGH PILE FABRIC HAVING COMBED-IN FIBRES

[75] Inventor: Erwin Schäberle, Gäufelden, Fed. Rep. of Germany

[73] Assignee: Sulzer Morat GmbH, Fed. Rep. of Germany

[21] Appl. No.: 103,091

[22] Filed: Dec. 12, 1979

[30] Foreign Application Priority Data

Dec. 13, 1978 [DE] Fed. Rep. of Germany ..... 2853717

[51] Int. Cl.[3] ..... D04B 9/14; D04B 35/10; F16D 7/02

[52] U.S. Cl. ..... 66/9 B; 66/163; 192/150; 403/342; 403/364

[58] Field of Search ..... 66/9 B, 157, 163; 192/150; 403/341, 342, 364

[56] References Cited

U.S. PATENT DOCUMENTS

| | | | |
|---|---|---|---|
| 1,849,466 | 3/1932 | Moore | 66/9 B X |
| 2,053,666 | 9/1936 | Hirth et al. | 403/342 X |
| 2,597,140 | 5/1952 | Versnel | 192/150 |
| 2,652,135 | 9/1953 | Flaton | 192/150 |
| 2,880,600 | 4/1959 | Moore | 66/9 B |
| 3,122,904 | 3/1964 | Brandt | 66/9 B |
| 3,269,147 | 8/1966 | Radtke et al. | 66/9 B |
| 3,447,343 | 6/1969 | Frishman et al. | 66/9 B |
| 3,709,002 | 1/1973 | Brandt et al. | 66/9 B |
| 3,736,011 | 5/1973 | Ward | 403/342 X |
| 3,896,636 | 7/1975 | Thore | 66/9 B |
| 3,918,274 | 11/1975 | York et al. | 66/9 B |
| 4,111,006 | 9/1978 | Golladay et al. | 66/9 B |
| 4,208,555 | 6/1980 | Ikeda et al. | 192/150 X |
| 4,293,060 | 10/1981 | Miller | 192/150 X |

FOREIGN PATENT DOCUMENTS

| | | | |
|---|---|---|---|
| 1992114 | 8/1968 | Fed. Rep. of Germany . | |
| 2455746 | 9/1977 | Fed. Rep. of Germany . | |
| 661243 | 3/1929 | France | 192/150 |
| 653762 | 5/1951 | United Kingdom . | |
| 662471 | 12/1951 | United Kingdom | 403/342 |
| 696035 | 8/1953 | United Kingdom . | |
| 725937 | 3/1955 | United Kingdom . | |
| 805022 | 11/1958 | United Kingdom . | |
| 1098812 | 1/1968 | United Kingdom . | |

*Primary Examiner*—W. Carter Reynolds

[57] ABSTRACT

Circular knitting machine for producing artificial furs or pile fabric having combed-in fibres comprises a drive motor and at least a carding device, which has a drive member being in operative connection with the drive motor for supplying rotary movement to the rotatable parts of the carding device. In order to achieve that in the event of excessive load in the rotating parts at least the operation of the carding device is automatically suspended, according to the invention there is provided between the drive motor (6) and the drive member (25) an overload clutch (23) having a device (30, 63) for automatically stopping the drive motor (6) (FIG. 2) when the overload condition is reached.

8 Claims, 3 Drawing Figures

CIRCULAR KNITTING MACHINE FOR PRODUCING HIGH PILE FABRIC HAVING COMBED-IN FIBRES

Figure 1:
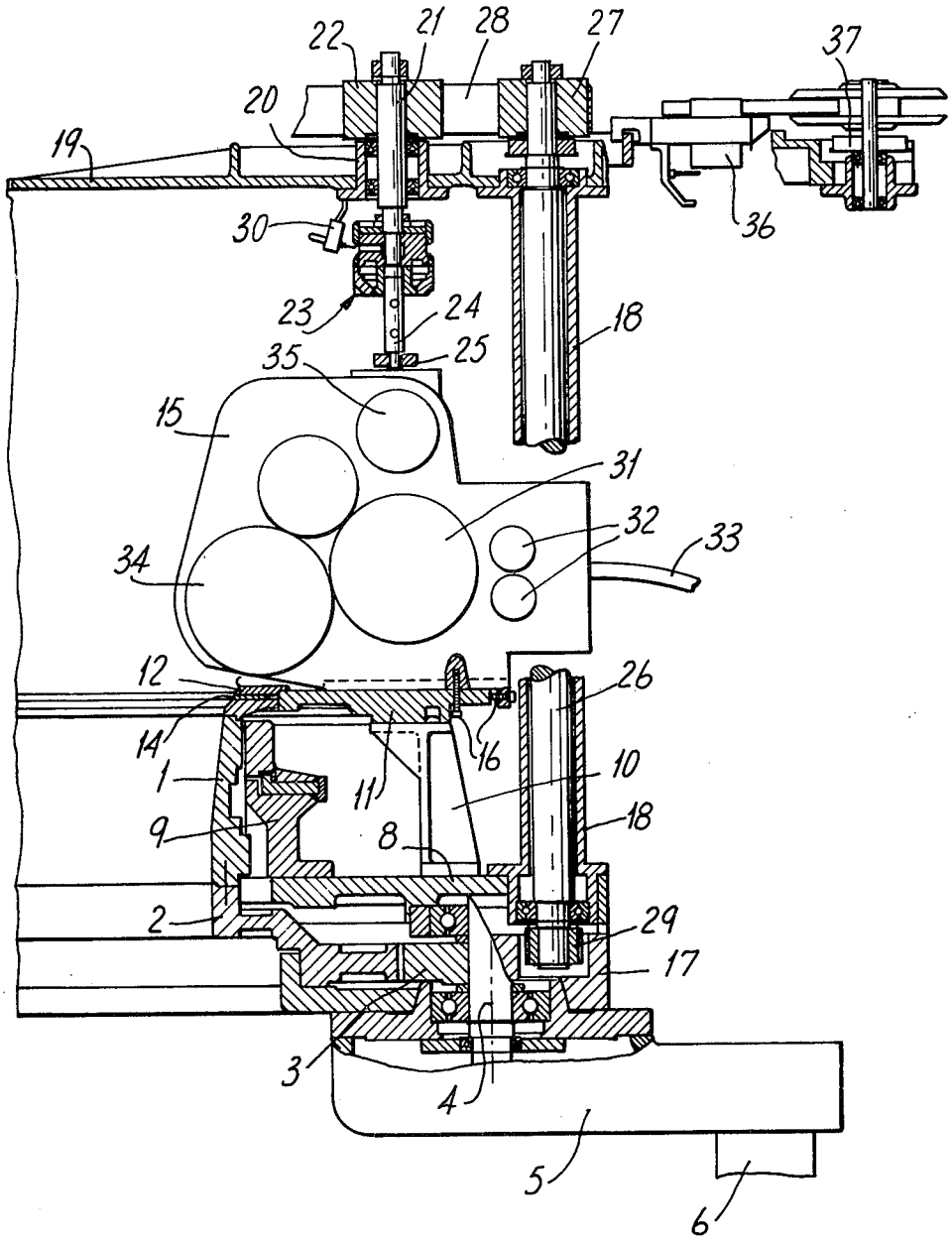

The invention relates to a circular knitting machine for producing fabrics having combed-in fibres, sometimes referred to as "high-pile fabrics", the knitting machine comprising a drive motor and at least a carding device which has a drive member being in operative connection with the drive motor for supplying the rotary movements for the rotatable parts of the carding device.

In known types of circular knitting machines of this type (U.S. Pat. No. 3,447,343 issued June 3, 1969; British Pat. No. 1107284 issued Mar. 3, 1968; U.S. Pat. No. 3,896,637 issued July 29, 1975, and U.S. Pat. No. 3,896,636 issued July 29, 1975) the carding devices are generally arranged directly on the circumference of the needle cylinder and coupled via gear wheels with the drive gear of the needle cylinder, thereby substantially blocking the access to the working points of the knitting needles and to the cam parts controlled by the knitting needles. Repairs, servicing and any changes to the parts of the machine hidden by a carding device make it necessary to take out and refit the complete carding device, a matter which is associated with long periods in which the machine cannot be used at all because of the clumsy construction and awkward attachment of the carding devices.

It is thus already known to mount the carding devices on a frame arranged above the needle cylinder and to drive the carding devices from above by a drive device also fixed to this frame (U.S. Pat. No. 3,918,274 issued Nov. 11, 1975), so that apart from the doffer rollers of the carding devices arranged directly above the knitting needles, there are no more parts which can block the access to the machine. Even with the way these carding devices are fitted the interchanging of the carding devices is cumbersome and time consuming. The same is true when considering the necessary precise adjustment of the carding devices relative to the knitting needles because of the rigid coupling between the carding devices and the drive device.

All known types of circular knitting machines of the aforementioned kind have in common that the carding devices are not sufficiently protected against overload. If a moving part of any carding device becomes blocked as a result of a momentary fault, i.e., as a result of fibre overload, this very often results in major damage, sometimes even breakdown of the entire carding device.

It is the object of the invention to improve a circular knitting machine of the aforementioned type to such a degree that when the rotating parts of any carding device becomes overloaded, at least the operation of the carding device becomes automatically suspended. According to another object of the invention it should be possible to easily fit and remove the carding devices and the free access to the working areas of the circular knitting machine should not be obstructed.

This object is achieved by the fact that in accordance with the invention between the drive motor and the drive member there is provided an overload clutch having a device for automatically stopping the drive motor when the overload condition is reached.

The fact that during the occurrence of faults which result in the blocking or partial blocking of any driven part of the carding devices according to the invention the drive of all carding devices and if necessary also the operation of the entire circular knitting machine is switched off, results in the particular advantage that the faultless working of the circular knitting machine need not be continuously monitored. The faults leading to the switching off at most can cause small knitting errors, but not faults over larger areas of the knitted fabric. This applies particularly when, apart from the drive motor for the carding devices, the drive motor for the needle cylinder is also switched off or one single motor is provided for both drives. Destruction of the carding devices is practically impossible now.

Advantageously, between the drive member and the overload clutch there is provided an articulated coupling which enables a simple adjustment of the carding device relative to the knitting needles.

Another advantageous development of the invention is characterised in that the driven part of the overload clutch and the end of the articulated coupling facing the same are adapted to be in the form of a connecting element of a rapid make or break connection. This enables each carding device to be coupled to the drive motor or other drive member or disconnected therefrom without much handling. Since only few screws are required, or one guide rail and a single screw is sufficient to fix the carding device to the machine frame, the installation and removal of the carding device is very simple.

Further advantageous features are obvious from the subclaims.

Figure 2:
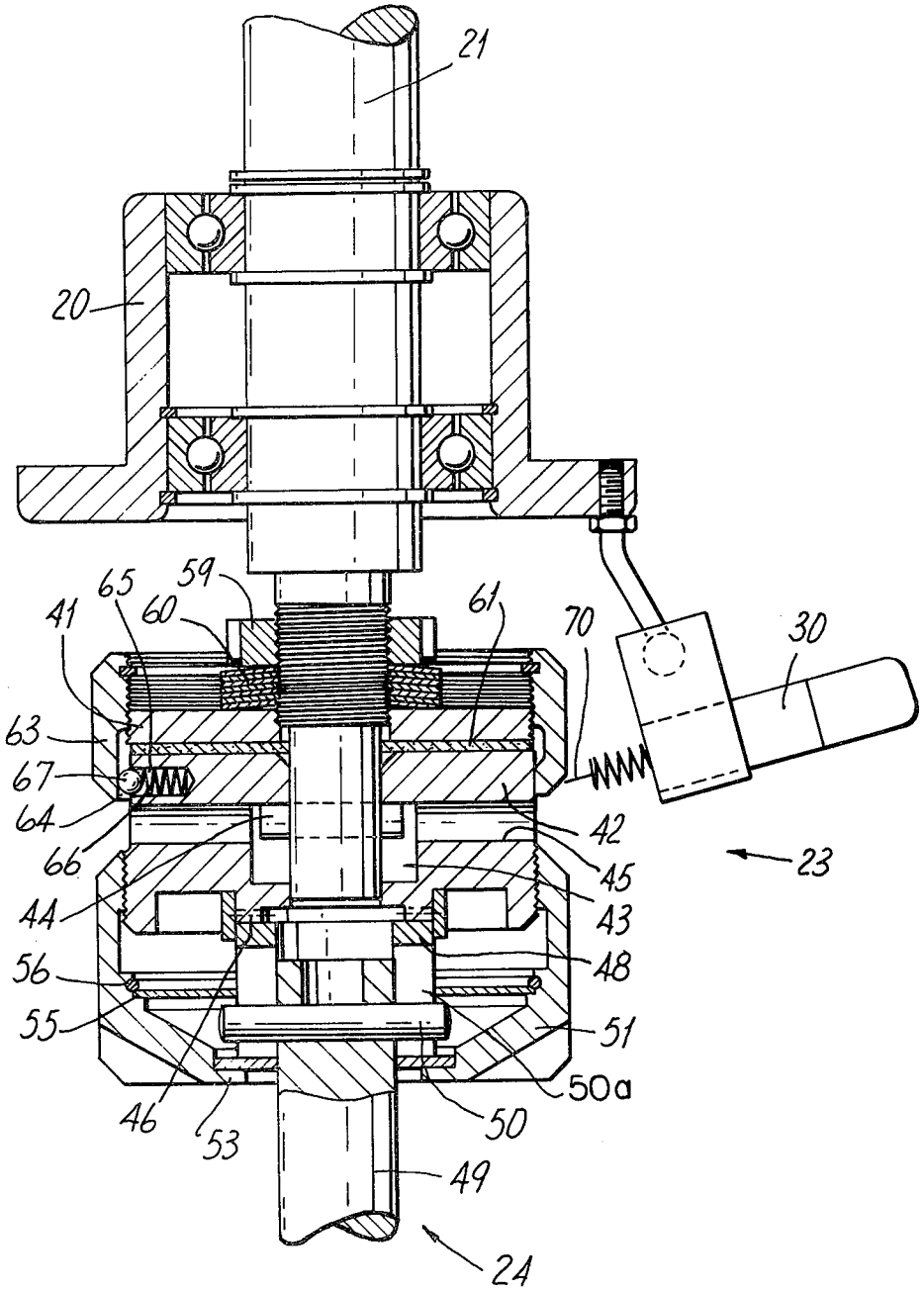

The invention is now described in more detail with the aid of the attached drawing of an example of an embodiment of the invention but which is not limited to the invention. There is shown:

FIG. 1—a longitudinal cross-section of the circular knitting machine according to the invention and;

FIG. 2—an enlarged longitudinal cross-section of the overload clutch, and

Figure 3:
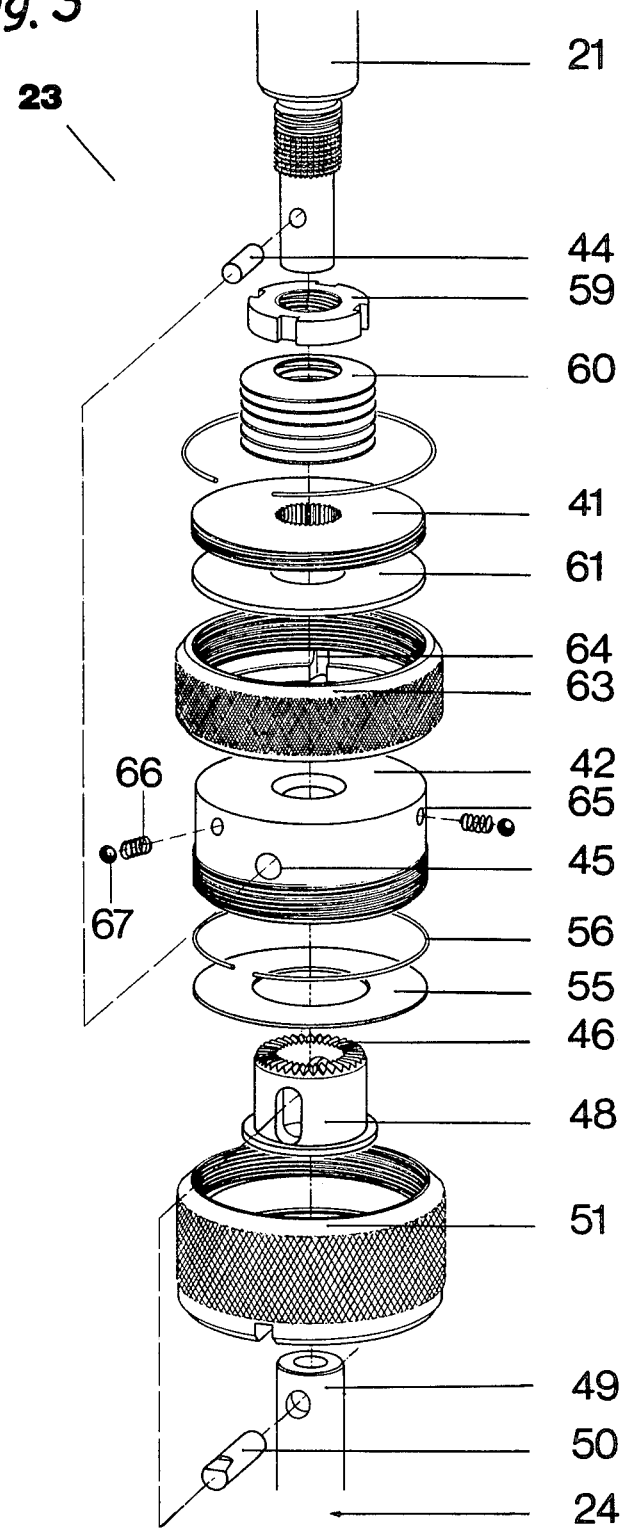

FIG. 3 is an exploded view of the overload clutch.

The schematically represented circular knitting machine shown in FIG. 1 only includes those parts necessary for understanding the invention. Connected to the lower end of a rotatable needle cylinder 1 is a gear ring 2 which meshes with a pinion 3 fixed to a shaft 4 which is connected via a gear unit 5 (schematically represented) to a drive motor 6 which activates the needle cylinder 1. Above the pinion 3 there is provided a base plate 8 which in a known manner carries a number of cylinder cams 9 and via supports 10 carries a cam plate 11 to which sinker cams 12 are secured. The cylinder cams 9 act on the knitting needles arranged in the needle cylinder 1 and the sinker cams act upon sinkers 14 which are mounted in a sinker ring which rotates together with the needle cylinder 1. Additionally, there is attached to the cam plate 11 by means of screws 16 at least one carding device 15 associated to a knitting system of the circular knitting machine. Alternatively, the carding device 15 can be slideably arranged in a radial guide and secured in the desired radial position by means of a single screw.

On a further base plate 17 around the circumference of the needle cylinder 1 there are secured more supports 18, for example three, which carry a bearing plate 19 arranged above the needle cylinder 1. In this bearing plate 19 above each carding device 15 a drive shaft 21 is rotatably mounted through a bearing bush 20, but axially immovable, a drive wheel 22 being fixed to the end of the drive shaft extending upwards over the bearing plate 19. The lower end of the drive shaft 21 arranged beneath the bearing plate 19 according to the invention is connected via an overload clutch 23 and an articulated coupling 24 with a drive member 25 which is rotatably mounted in the housing of the carding device 15 and from which are taken the rotary movements for all rotating cylinders of the carding device.

In at least one of the supports 18 there is rotatably mounted, but axially immovable, a shaft 26 connected to the upper end which extends through the bearing plate 19 there is fixed a drive wheel 27 which via a belt 28 is connected with all available drive wheels 22 and therefore serves to drive all the available carding devices 15. To the other end of the shaft 26 extending through the lower part of the support 26 there is fixed a pinion 29 which meshes with pinion 3 resulting in the needle cylinder 1 as well as all the carding devices 15 being commonly driven by drive motor 6. The electricity supply circuit for the drive motor 6 includes the circuits of sensing devices 30 (not described in more detail). Each one of these sensing devices 30 is provided for each overload clutch 23 and is so arranged as to produce a control signal for switching off the drive motor 6 as soon as the associated carding device 15 through the overload clutch induces a resistance to the drive which is above a preselected adjustable value.

The fundamental construction and drive of the carding device 15 is known and therefore does not require further explanation (see U.S. Pat. No. 3,447,343, British Pat. No. 1107284, U.S. Pat. No. 3,896,637 and U.S. Pat. No. 3,896,636.) It is sufficient to mention that each carding device 15 generally has a main cylinder 31 to which a fibre band or sliver 33 is fed by feed rollers 32 and which also has a doffer roller 34 which takes up the fibres from the main cylinder 31 and feeds them to the knitting needles. For transferring the rotary movement from the drive member 25 to the main cylinder 31, the supply rollers 32 and the doffer rollers 34, there are provided in a known manner helical, tooth, belt or chain drives which are indicated by reference numerals 35.

On the bearing plate 19 there are finally also arranged the usual thread supply devices 36 and the associated drives 37 by means of which the knitting needles are supplied with the thread (not shown).

The overload 23 according to the invention is shown in enlarged form in FIG. 2 and in exploded view in FIG. 3. It is adapted to be in the form of a friction clutch and contains a drive part 41 mounted by means of a wedge etc., non-rotatable relative to drive shaft 21 and axially displaceably on the drive shaft 21, and a driven part 42 rotatably mounted on the drive shaft 21. The driven part 42 in its central part surrounding the drive shaft 21 is provided with an annular groove 43 in which are arranged the two ends of the transverse pin 44 extending through the drive shaft 21 and which pin 44 is introduced through a transverse drilling 45 of the driven part. The diameter of the transverse pin 44 is preferably a little smaller than the height of the annular groove 43 so that the driven part 42 whilst securely held on the drive shaft 21, can move to and fro on the drive shaft 21, but restricted within limits in the axial direction in order to equalize tolerances.

The lower end face of the driven part 42 has serrations 46, e.g., a Hirth-type serrations. Appropriate serrations are provided in the upper end face of a clutch ring 48 which forms the connecting end of the articulated clutch 24, e.g., a ball joint which according to FIG. 1 is connected with the drive member 25 of the carding device 15. The clutch ring 48 is seated on the last shaft element 49 of the articulated clutch 24 and is fixed to the same by means of a transverse pin 50 which extends through a transverse drilling of the shaft element 49 and an elongated hole in the clutch ring 48. The diameter of the transverse pin 50 may be a little smaller than the length of the elongated hole 50*a* passing through the clutch ring 48 so that the clutch ring 48 whilst non-rotatable relative to shaft element 49, but because of tolerance equalization is fixed to the shaft element 49 axially displaceable within limits. Alternatively the shaft elements 49 and the clutch rings 48 may also be connected by means of spline shafts, adjusting springs etc.

The clutch ring 48 is arranged inside a securing ring 51 mounted on the shaft element 49, the part of the ring 51 facing the driven part 42 having an internal thread which is screwed onto a corresponding outer thread provided on the end of the driven part 42 facing the clutch ring 48. The end of the securing ring 51 facing away from the driven part 42 has a flange-like nose 53, extending inwardly in the direction of the shaft element 49, which supports the clutch ring in FIG. 2 from below and secures it against falling out. So as to retain the clutch ring 48 in the securing ring 51 against dropping out also in the opposite direction the ring 51 has a shoulder on its inner circumference on which is arranged a retaining ring 55 which by means of a Seeger ring 56 etc., is fixed to the securing ring 51 and pushes from above in FIG. 2 against the ends of the transverse pin 50 extending from the clutch ring 48. In this way the clutch ring 48 together with the shaft element 49 are rotatably and inseparably mounted in the securing ring 51, and if necessary also axially nondisplaceably. For positively connecting the articulate clutch 24 with the drive part 42 of the overload clutch, it is sufficient to screw the securing ring 51 onto the driven part 42 and to tighten the same until the two spur gears are firmly locked together and it is ensured that the shaft element 49 is positively driven during the drive phase of the driven part 42. The driven part 42 and the end of the articulated clutch 24 facing it thus provide the connecting elements of a rapid make and break connection.

For adjusting the torque or the maximum permissible load of the clutch which can be maximally transmitted by the overload clutch 23 from the side of the carding device 15, the drive shaft 21 in FIG. 2 is provided with a threaded part holding a nut 59 at a point above the place at which is arranged the drive part 41. Between the nut 59 and the drive part 41 plate springs 60 are arranged on the drive shaft 21 which are supported on the drive part 41. By tightening the nut 59 the frictional force between the drive part 41 and the driven part 42 is established. For improving the frictional properties the drive part 41 and/or the driven part 42 may be coated with a special layer 61.

So as to automatically determine whether the driven part 42 as a result of a disruption in the carding device 15 is wholly or temporarily blocked the drive part 41 on its outer circumference has an external thread on which is screwed a stop ring 63 having a corresponding internal thread. In FIG. 2 the stop ring 63 in a section enclosing the upper end of the driven part 42 and extending over the end face of the drive part 41 has at least one longitudinal groove 64 provided in the inner part of the external surface and in alignment with a radial blind hole 65 in the upper part of the driven part 42 and together with the same and a pressure spring 66 in the blind hole 65 forms a ball notch by the pressure spring 66 pressing the ball 67 into the longitudinal groove. The force of the pressure spring 66 is such that the rotary movement of the stop ring 63 during blocking of the driven part 42 with the aid of the ball notch is also blocked and the stop ring 63 thus becomes axially displaced by the further rotating drive part 41 and the outer thread of the same; the ball 67 meanwhile slides in the longitudinal groove 64. The extent of the axial displacement of the stop ring 63 can be monitored with the aid of the monitoring device 30 which produces a control signal for switching off the drive motor 6 as soon as the axial displacement of the stop ring 63 has reached a predetermined value. After the interruption has been removed, the stop ring 63, after overcoming the force of the ball notch, is rotated back into its starting position.

The overload clutch 23 according to the invention essentially offers three advantages. First of all it ensured that an interruption within the carding device 15 cannot have a disrupting effect on the elements of the drive device arranged between the overload clutch 23 and the drive motor 6, the maximum permissible overload of these parts being adjustable by means of the nut 59 and the plate springs 60. The overload clutch 23 furthermore enables the immediate shut-down of the drive motor 6 in the event of a permanent blockage, or a temporary blockage which recurs several times, or a delay in the driven part 42, thus preventing that the circular knitting machine despite the interruptions continues to work and produces faulty material.

Finally, the clutch according to the invention is designed as a compact unit and at the same time as a connecting element for a correspondingly designed connecting element of the articulated clutch 24 so that the carding device 15, after unscrewing the securing ring 51, can be decoupled from the circular knitting machine and after loosening the screws 16 (FIG. 1) can be lifted as one block from the cam plate 11.

The embodiment example described can be varied in a number of ways. First of all, neither the overload clutch 23 nor the type of articulated coupling 24 are restricted to the embodiment example. Apart from other frictional couplings such as disc clutches, in place of the overload clutch 23 in principle it is also possible to use positive coupling (break couplings) which have an intermediate link which breaks when overloaded. Friction couplings however have the advantage of being useable again immediately after rectifying the fault without requiring new parts. Articulated couplings 24 may include in particular articulated joint couplings, resilient articulated shafts, universal joints and couplings or ball joints.

Even the type of overload sensing may be varied. The described type of translation of a relative rotation, indicated as overload between the drive part 41 and the driven part 42 of the overload clutch 23, into a translatory movement of the stop ring 63 does offer the advantage that simple and known sensing deives 30 can be used. Suitable sensing devices for example are U.S. Pat. No. 3,509,739 issued May 5, 1970 which are already used in monitoring needle breakages and have an elastic sensor 70, made of an electrically conducting material, which is arranged in the control circuit of the thyristor whose main current circuit contains a relay which on touching the sensor 70 responds, as a result of the stop ring 63 made of the electrically conducting material and because of the thyristor action, and actuates a switch in the circuit of the drive motor 6.

Finally, it is possible to connect in some other way the driven part 42 of the overload clutch 23 with the associated end of the articulated coupling 24 e.g. by means of connecting together the securing ring 51 and the driven part 42 in the manner of a bayonet catch. However, the embodiment example described does offer the advantage that each carding device 15 can be positively connected with the drive motor 6 by simply tightening the securing ring 51.

I claim:

1. Circular knitting machine for producing pile fabric having combed-in fibres, comprising a drive motor and at least a carding device which has a drive member being in operative connection with the drive motor for supplying rotary movements to the rotatable parts of the carding device, characterized in that between the drive motor (6) and the drive member (25) there is provided an overload clutch (23) having a driven part (42) and a device (30,63) for automatically stopping the drive motor (6) when the overload condition is reached, that between the drive member (25) and the overload clutch (23) there is provided a coupling (24), and that the coupling (24) and said driven part (42) are the connecting elements of a rapid make or break connection for rapidly connecting or disconnecting said overload clutch and said drive member.

2. Circular knitting machine for producing pile fabric having combed-in fibres, comprising a drive motor and at least a carding device which has a drive member being in operative connection with the drive motor for supplying rotary movements to rotatable parts of the carding device, characterized in that between the drive motor (6) and the drive member (25) there is provided an overload clutch (23) having a drive part (41) coupled to said drive motor (6), a driven part (42) and a device (30,63) for automatically stopping the drive motor (6) when the overload condition is reached, that between the drive member (25) and the overload clutch (23) there is provided a coupling (24), that the coupling (24) and said driven part (42) are the connecting elements of a rapid make or break connection for rapidly connecting and disconnecting said overload clutch and said drive member, and that said drive part (41) has an outer thread onto which is screwed a stop ring (63) having a corresponding inner thread, which stop ring (63) is mounted on and held non-rotatably but axially displaceably relative to the driven part (42) of the overload clutch (23).

3. Circular knitting machine according to claim 1 or 2, characterized in that the overload clutch (23) is a friction clutch.

4. Circular knitting machine according to claim 2, characterized in that said device (30,63) for automatically stopping the drive motor (6) contains a sensing device (30) for sensing the relative position of the drive part (41) and the driven part (42), which sensing device (30) produces a control signal for switching off the drive motor (6) when a predetermined relative displacement of these parts occurs.

5. Circular knitting machine according to claim 2 or 4, characterized in that the permitted overload of the clutch (23) is adjustable.

6. Circular knitting machine according to any one of claims 1, 2 or 4, characterized in that it has a rotatable needle cylinder (1) in operative connection with the drive motor, and there is a drive device (27,28) arranged above the needle cylinder (1) in operative connection with the drive motor (6) for driving the rotatable parts of said carding device, the drive device (27,28) being in operative connection with at least one drive shaft (21), said drive shaft (21) being connected through said overload clutch (23) to said drive member (25) of said carding device (15), said drive member being mounted on an upper part of said carding device.

7. Circular knitting machine according to claim 6, characterized in that the needle cylinder (1) is provided with sinker cams (12) and the carding device (15) is fitted to a cam plate (11) of the sinker cams (12).

8. Circular knitting machine according to claim 1, 2 or 4, characterized in that said make or break connection has a securing ring (51) which is rotatably secured to one end of the coupling (24), said securing ring having an inner thread, and that the driven part (42) of the overload clutch (23) has a corresponding outer thread onto which may be screwed said inner thread of said securing ring (51) for tightening said connection.

* * * * *